US009834026B2

(12) United States Patent
Umezawa

(10) Patent No.: US 9,834,026 B2
(45) Date of Patent: Dec. 5, 2017

(54) DECOLORING APPARATUS AND PAPER CONVEYANCE METHOD

(71) Applicants: KABUSHIKI KAISHA TOSHIBA, Minato-ku, Tokyo (JP); TOSHIBA TEC KABUSHIKI KAISHA, Shinagawa-ku, Tokyo (JP)

(72) Inventor: Noriyuki Umezawa, Kanagawa (JP)

(73) Assignees: KABUSHIKI KAISHA TOSHIBA, Tokyo (JP); TOSHIBA TEC KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 15/586,355

(22) Filed: May 4, 2017

(65) Prior Publication Data

US 2017/0232774 A1 Aug. 17, 2017

Related U.S. Application Data

(63) Continuation of application No. 14/969,432, filed on Dec. 15, 2015, now Pat. No. 9,669,643.

(51) Int. Cl.
*B41M 7/00* (2006.01)
*B41J 13/00* (2006.01)

(52) U.S. Cl.
CPC ..... *B41M 7/0009* (2013.01); *B41J 13/0009* (2013.01)

(58) Field of Classification Search
CPC ..... B41M 7/00; B41M 7/0009; B41M 7/009; B41J 13/0009
See application file for complete search history.

(56) References Cited

U.S. PATENT DOCUMENTS 6,104,420 A * 8/2000 Matsumoto ..... B41J 2/471 347/133
8,730,544 B2 5/2014 Megawa
9,669,643 B1 * 6/2017 Umezawa ..... B41M 7/0009
2013/0258027 A1 * 10/2013 Yahata ..... H04N 1/00567 347/179

OTHER PUBLICATIONS

Non-Final Office Action for U.S. Appl. No. 14/969,432, dated Nov. 4, 2016, 19 pages.

* cited by examiner

*Primary Examiner* — Kristal Feggins
(74) *Attorney, Agent, or Firm* — Amin, Turocy & Watson LLP

(57) ABSTRACT

A decoloring apparatus comprises a decoloring unit configured to carry out a decoloring processing which decolors the color of an image formed on a paper with a decolorable color material; a scanner configured to scan the papers to which the decoloring processing is carried out; a memory configured to store data of a predetermined image indicating a predetermined form formed on the paper; a conveyance section configured to convey the paper scanned by the scanner to a plurality of paper discharging positions; and a control section configured to determine whether or not the scan image generated by the scanner is consistent with the predetermined image, and to drive the conveyance section to respectively convey the papers on each of which the scan image is consistent with the predetermined image and the papers on each of which the scan image is not consistent with the predetermined image to different positions.

6 Claims, 5 Drawing Sheets

DECOLORING APPARATUS AND PAPER CONVEYANCE METHOD

CROSS-REFERENCE TO RELATED APPLICATIONS

This application is a Continuation of application Ser. No. 14/969,432 filed Dec. 15, 2015, the entire contents of which are incorporated herein by reference.

FIELD

Embodiments described herein relate generally to a decoloring apparatus and a paper conveyance method.

BACKGROUND

A decoloring apparatus heats a paper to decolor the color of image printed on the paper. The processing of decoloring the color of image is referred to as a decoloring processing. After the decoloring apparatus carries out the decoloring processing, a scanner scans the paper to determine whether or not there is an image left on the paper to which the decoloring processing is carried out. Then, when there is an image left on the paper, a CPU (Central Processing Unit) determines the paper as a defective paper (that is, the paper that cannot be reused).

A predetermined form may be printed on the paper with non-decolorable toner in advance. The predetermined form may be a frame in a predetermined format, or a predetermined mark. When an image is formed with a decolorable toner on the paper where the predetermined form is printed, the predetermined form still remains even if the decoloring processing is carried out on the paper.

As stated above, when the paper on which the image is left is determined as the defective paper, the paper on which the predetermined form still remains should also be determined as the defective paper. However, if the color of the image of which the color should have been decolored is decolored, the paper on which only the predetermined form remains can be reused and shouldn't be thought as the defective paper.

The purpose of this invention is to provide a decoloring apparatus which can distribute other papers and the paper on which only the predetermined form still remains among the papers to which the decoloring processing is carried out.

DETAILED DESCRIPTION

Figure 1:
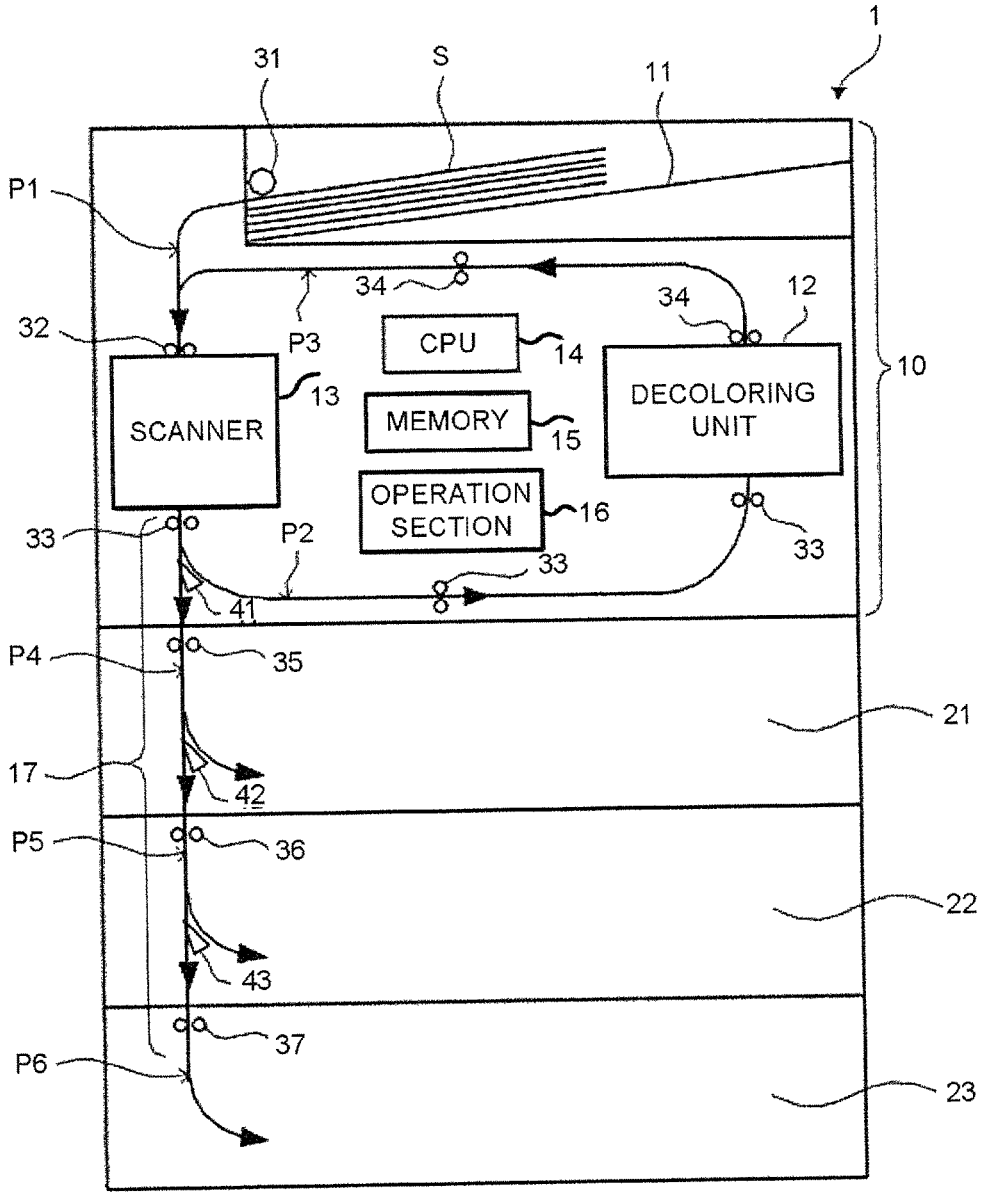
FIG. 1 is a schematic diagram illustrating the whole constitution of a decoloring apparatus.

In accordance with an embodiment, a decoloring apparatus comprises a decoloring unit, a scanner, a memory, a conveyance section and a control section. The decoloring unit carries out a decoloring processing which decolors the color of an image formed on a paper with a decolorable color material. The scanner scans the papers to which the decoloring processing is carried out. The memory stores data of a predetermined image indicating a predetermined form formed on the paper. The conveyance section conveys the papers scanned by the scanner to a plurality of paper discharging positions. The control section determines whether or not the scan image generated by the scanner is consistent with the predetermined image, and drives the conveyance section to respectively convey the papers on each of which the scan image is consistent with the predetermined image and the papers on each of which the scan image is not consistent with the predetermined image to different positions.

Various Embodiments will be described hereinafter with reference to the accompanying drawings.

First Embodiment

Hereinafter, the decoloring apparatus according to the first embodiment is described with reference to the accompanying drawings.

A decoloring apparatus 1 carries out a decoloring processing for decoloring the color of an image (decolorable color material) on a paper on which the image is formed with decolorable color material (toner or ink).

The decolorable color material includes color generation compound, color developing agent and decoloring agent. For example, the color generation compound may be leuco dye. For example, the color developing agent may be phenols. The decoloring agent is compatible with the color generation compound when being heated, and has no affinity with the color developing agent. The color material develops color through the interaction of the color generation compound and the color developing agent. Further, the color of the color material will be decolored as the interaction between the color generation compound and the color developing agent is eliminated by the heating at a temperature above a decoloring temperature.

Further, the "decoloring" herein refers to make an image formed with a color material in a color (containing not only a chromatic color but also an achromatic color such as white and black) different from the base color of paper invisible.

The decoloring apparatus 1 comprises a device main body 10 and three cassettes 21~23. Further, the number of cassettes can be properly set.

The device main body 10 includes a paper feed tray 11, a decoloring unit 12, a scanner 13, a CPU 14, a memory 15, an operation section 16, and a conveyance section 17. The CPU 14 acts as a control section of the present invention.

The paper feed tray 11 is arranged above the device main body 10 to store papers S. A paper feed roller 31 feeds the paper S stored in the paper feed tray 11 to a conveyance path P1. Further, it is not necessary to arrange the paper feed tray 11 above the device main body 10, and for example, the paper feed tray 11 can be arranged on the lateral sides of the device main body 10.

The decoloring unit 12 includes a heater which heats the papers S. When the image formed on the paper S is an image formed with the decolorable color material, the decoloring unit 12 heats the paper S to erase the color of the image. The scanner 13 scans the paper S and outputs image data generated through the scan operation to the CPU 14.

The CPU 14 controls the operations of the whole decoloring apparatus 1. The memory 15 stores predetermined information. The predetermined information contains information required to control the operations of the decoloring apparatus 1 by the CPU 14, and the image data generated by the scanner 13.

The operation section 16 is used to input the predetermined information to the decoloring apparatus 1. The operation section 16 includes a touch panel type display section and various operation keys, and for example, can be arranged at the upper part of the device main body 10. The user operates the operation section 16 to instruct the operations of the decoloring apparatus 1 such as starting a decoloring processing. Further, the decoloring apparatus 1 may be provided with no operation section 16. For example, the operation section 16 may be arranged in an external device connected with the decoloring apparatus 1 in a wired or wireless manner.

Conveyance rollers 32 and the conveyance path P1 are arranged between the paper feed tray 11 and the scanner 13 to convey the paper S, and the conveyance rollers 32 are arranged along the conveyance path P1. The conveyance roller 32 guides the paper S fed from the paper feed tray 11 to the scanner 13 along the conveyance path P1. Conveyance rollers 33 and a conveyance path P2 are arranged between the scanner 13 and the decoloring unit 12 to convey the paper S, and the conveyance rollers 33 are arranged along the conveyance path P2. The conveyance roller 33 guides the paper S passing through the scanner 13 to the decoloring unit 12 along the conveyance path P2.

Conveyance rollers 34 and the conveyance path P3 are arranged between the decoloring unit 12 and the scanner 13 to convey the paper S, and the conveyance rollers 34 are arranged along the conveyance path P3. The conveyance roller 34 guides the paper S passing through the decoloring unit 12 to the scanner 13 along the conveyance path P3. One part of the conveyance path P3 is overlapped with one part of the conveyance path P1, and the conveyance rollers 32 are arranged on the overlapped part of the conveyance paths P3 and P1.

The conveyance rollers 33 and conveyance rollers 35 and the conveyance path P4 are arranged between the scanner 13 and the first cassette 21, and the conveyance rollers 35 are arranged along the conveyance path P4. The conveyance roller 35 guides the paper S passing through the scanner 13 to the first cassette 21 along the conveyance path P4. One part of the conveyance path P4 is overlapped with one part of the conveyance path P2, and the conveyance rollers 33 are arranged on the overlapped part of the conveyance paths P4 and P2. A flapper 41 which switches the conveyance paths P4 and P2 is arranged at the branching part of the conveyance paths P4 and P2.

Conveyance rollers 36 and a conveyance path P5 are arranged between the scanner 13 and the second cassette 22, and the conveyance rollers 36 are arranged along the conveyance path P5. The conveyance roller 36 guides the paper S passing through the scanner 13 to the second cassette 22 along the conveyance path P5. One part of the conveyance path P5 is overlapped with one part of each of the conveyance paths P2 and P4. The conveyance rollers 33 are arranged on the overlapped part of the conveyance paths P5 and P2, and the conveyance rollers 35 are arranged on the overlapped part of the conveyance paths P5 and P4. A flapper 42 which switches the conveyance paths P4 and P5 is arranged at the branching part of the conveyance paths P4 and P5.

Conveyance rollers 37 and a conveyance path P6 are arranged between the scanner 13 and the third cassette 23, and the conveyance rollers 37 are arranged along the conveyance path P6. The conveyance roller 37 guides the paper S passing through the scanner 13 to the third cassette 23 along the conveyance path P6. One part of the conveyance path P6 is overlapped with one part of each of the conveyance paths P2, P4 and P5. The conveyance rollers 33 are arranged on the overlapped part of the conveyance paths P6 and P2, the conveyance rollers 35 are arranged on the overlapped part of the conveyance paths P6 and P4, and the conveyance rollers 36 are arranged on the overlapped part of the conveyance paths P6 and P5. A flapper 43 which switches the conveyance paths P5 and P6 is arranged at the branching part of the conveyance paths P5 and P6.

The CPU 14 controls the operations of the paper feed roller 31, the conveyance rollers 32~37 and the flappers 41~43. Further, the conveyance section 17 includes the conveyance rollers 33, 35~37 and the flappers 41~43 arranged on the conveyance paths P4~P6.

Different categories of papers S can be respectively distributed to the first cassette 21, the second cassette 22 and the third cassette 23. In the present embodiment, the category of the paper S can be distinguished through the surface state of the paper S, and for example, it means that there is only an image of a predetermined form described later on the paper S, there is no any image, stain or rip on the paper S, and there is an image, a stain or a rip other than the predetermined form on the paper S. Consequently, it is possible to store only one category of papers S in each of the cassettes 21~23. The user can operate the operation section 16 to assign the different categories of the papers S to each of the cassettes 21~23.

Next, the operations of the decoloring apparatus 1 are described.

Figure 2:
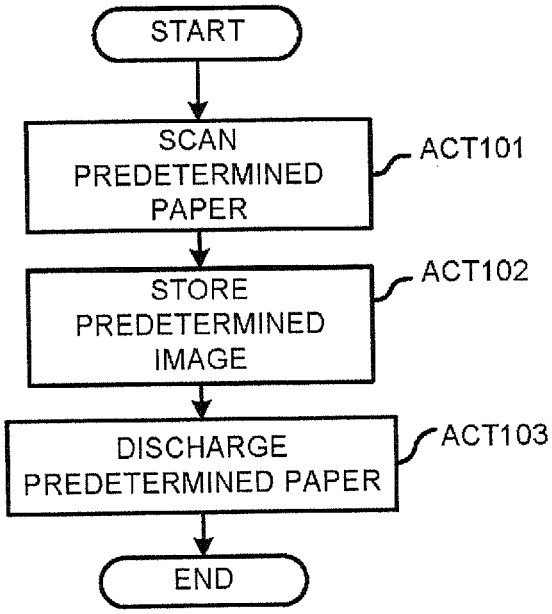
FIG. 2 is a flowchart illustrating a processing of registering a predetermined image.

First, the decoloring apparatus 1 can carry out the processing shown in FIG. 2. The processing shown in FIG. 2 refers to storing image data of a paper (referred to as predetermined paper) S on which only a predetermined form is printed in the memory 15.

The predetermined form is an image printed on the paper S in advance. For example, the predetermined form may be a frame in a predetermined format or a predetermined mark. When printing the predetermined form on the paper S, a non-decolorable color material is used. Herein, this color material will not be decolored even if a decoloring processing is carried out. Further, an image can be formed on the predetermined paper S with a decolorable material.

Figure 3:
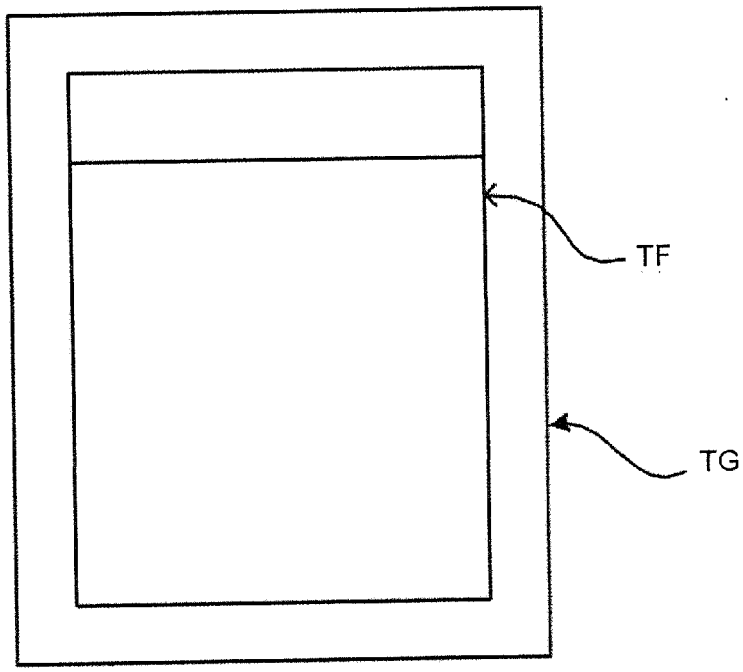
FIG. 3 is a diagram of the predetermined image.

When the predetermined paper S is placed on the paper feed tray 11, the predetermined paper S passes through the conveyance path P1, and then move to the scanner 13 by the conveyance roller 32. Then the scanner 13 scans the predetermined paper S (ACT 101). Through the scanning of the scanner 13, for example, an image (predetermined image) TG shown in FIG. 3 can be obtained. The predetermined image TG that is shown in FIG. 3 contains a predetermined form TF indicating a predetermined frame.

The CPU 14 stores the data of the predetermined image TG generated by the scanner 13 in the memory 15 (ACT 102). The CPU 14 drives the conveyance rollers 33 and 35 and the flappers 41 and 42 to enable the predetermined paper S passing through the scanner 13 to move along the conveyance path P4 and to be discharged to the first cassette 21 (ACT 103). Herein, the first cassette 21 is used to store the predetermined paper S. Further, the cassettes to which the predetermined paper S is discharged can be selected properly.

Figure 4:
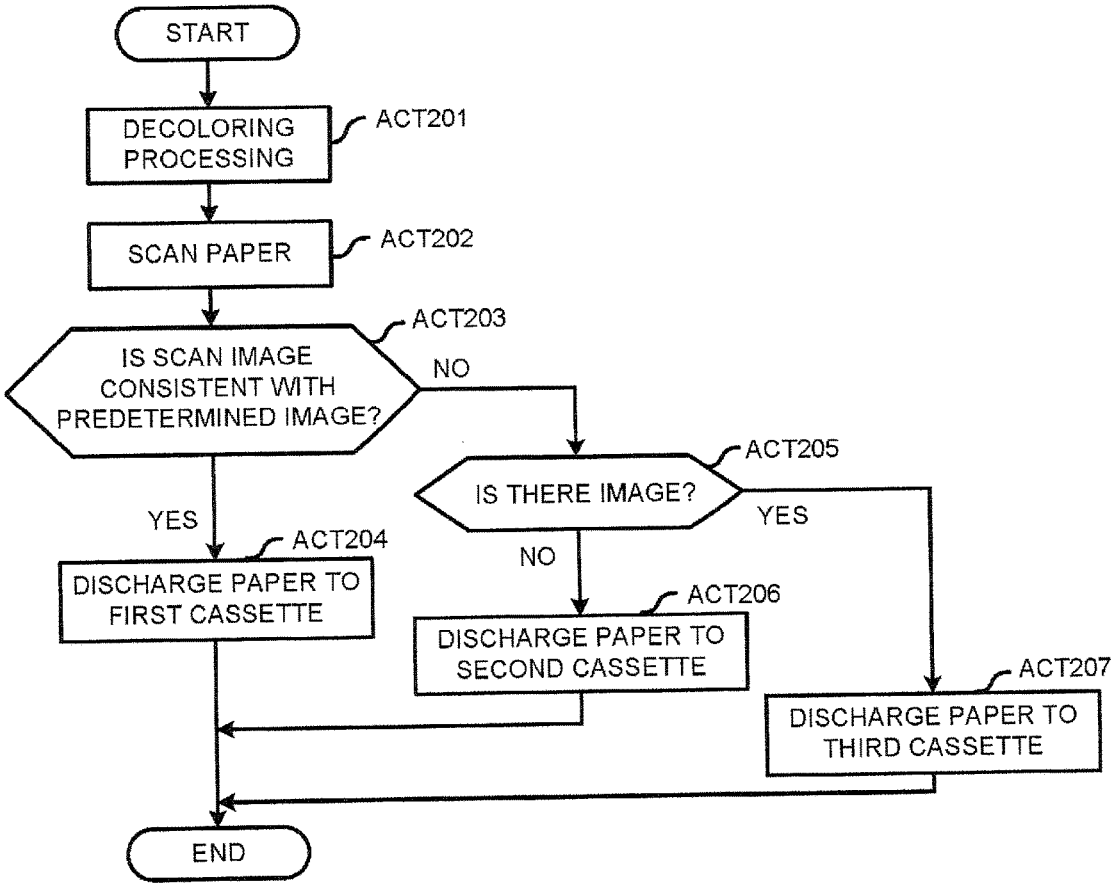
FIG. 4 is a flowchart illustrating a decoloring processing and a processing for distributing papers to which the decoloring processing is carried out in a first embodiment.

Next, the decoloring apparatus 1 can carry out the processing shown in FIG. 4. When the processing shown in FIG. 4 is started, the papers S on which images are formed with the decolorable material are stored in the paper feed tray 11.

The paper S stored in the paper feed tray 11 passes through the conveyance path P1, the scanner 13 and the conveyance path P2, and then moves to the decoloring unit 12. Herein, the paper S just passes through the scanner 13 directly without being scanned by the scanner 13. The decoloring unit 12 heats the paper S to decolor the color of the decolorable color material (ACT 201).

In the decoloring processing carried out by the decoloring unit 12, though the color of all images (referred to as decoloring image) formed with the decolorable color material are decolored, the color of part of decoloring image may remain. Further, if there is an image handwritten with a non-decolorable color material on the paper S, this image will remain on the paper S even if a decoloring processing is carried out on the paper S. In addition, even if a decoloring processing is carried out on the paper S on which the predetermined form is printed, the predetermined form will remain on the paper S because the predetermined form is formed with the non-decolorable color material.

The paper S to which the decoloring processing is carried out passes through the conveyance path P3 and moves to the scanner 13. The scanner 13 scans the paper S to which the decoloring processing is carried out (ACT 202). The CPU 14 determines whether or not the image (referred to as scan image) SG generated by the scanner 13 is consistent with the predetermined image TG that is obtained through the processing shown in FIG. 2 and stored in the memory 15 (ACT 203). Specifically, whether or not the scan image SG is consistent with the predetermined image TG can be determined by carrying out a matching processing between the scan image SG and the predetermined image TG.

When the scan image SG is consistent with the predetermined image TG, the CPU 14 determines that only the predetermined form is printed on the paper S. Then, the CPU 14 drives the conveyance rollers 33 and 35 and the flappers 41 and 42 to enable the scanned paper S to move along the conveyance path P4 and to be discharged to the first cassette 21 (ACT 204). In this way, the first cassette 21 stores the predetermined papers S only.

When the scan image SG is not consistent with the predetermined image TG, the CPU 14 carries out the processing in and after ACT 205.

When the scan image SG is not consistent with the predetermined image TG, there exists two cases. In the first case, since there is stain or rip on the paper S and an image different from the predetermined form TF is formed on the paper S, the scan image SG is not consistent with the predetermined image TG regardless of whether or not the predetermined form TF is contained on the paper S. In the second case, since there is no stain or rip on the paper S and no image is formed on the paper S, the scan image SG is not consistent with the predetermined image TG.

Figure 5:
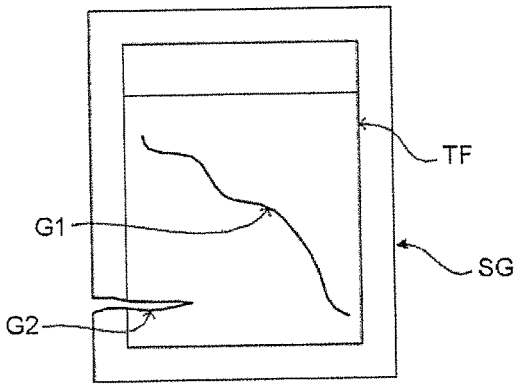
FIG. 5 is a diagram illustrating a scan image containing a stain or a rip.

FIG. 5 is an example of the scan image SG. In addition to the predetermined form TF, the scan image SG shown in FIG. 5 includes an image G1 indicating a stain and an image G2 indicating a rip. As the predetermined image TG shown in FIG. 3 does not include the images G1 and G2, the scan image SG shown in FIG. 5 is not consistent with the predetermined image TG shown in FIG. 3.

As long as the scan image SG includes at least one of the images G1 and G2, the scan image SG is not consistent with the predetermined image TG. Further, though the scan image SG includes the predetermined form TF in FIG. 5, regardless of whether or not there is the predetermined form TF in the scan image SG, the scan image SG is not consistent with the predetermined image TG as long as the scan image SG includes the image G1 and the image G2.

In the processing in ACT 203 in FIG. 4, when the scan image SG is not consistent with the predetermined image TG, the CPU 14 determines whether or not there is an image in the entire area of the scan image SG (ACT 205). When there is a stain or rip on the paper S, the scan image SG includes the image G1 indicating stain and the image G2 indicating rip as shown in FIG. 5. When extracting the images G1 and G2 from the scan image SG, the CPU 14 can determine that there are images in the entire area of the scan image SG.

Further, in the case in which the scan image SG is not consistent with the predetermined image TG, when an image different form a stain or rip is formed on the paper S, the CPU 14 can also determine that there is an image in the entire area of the scan image SG. As stated above, the image different from a stain or rip may be, for example, the image handwritten with the non-decolorable color material.

When extracting no image (the images G1, G2 and the like) from the scan image SG, the CPU 14 can determine that there is no image, stain, or rip on the paper S.

When there is no image in the entire area of the scan image SG, the CPU 14 drives the conveyance rollers 33, 35 and 36 and the flappers 41~43 to enable the scanned paper S to move along the conveyance path P5 and to be discharged to the second cassette 22 (ACT 206). As there is no stain or rip and no image is formed on the paper S stored in the second cassette 22, such a paper S can be reused. Consequently, the second cassette 22 can only store the papers S that can be reused.

When there is an image in the entire area of the scan image SG, the CPU 14 drives the conveyance rollers 33, 35~37 and the flappers 41~43 to enable the scanned paper S to move along the conveyance path P6 and to be discharged to the third cassette 23 (ACT 207). Consequently, the third cassette 23 only stores the paper S on which there is a stain, a rip or an image other than the predetermined form TF.

According to the decoloring apparatus 1 in the present embodiment, it is determined that whether or not the scan image SG is consistent with the predetermined image TG stored in the memory 15 in advance, and in this way, it is possible to specify the paper S on which only the predetermined form TF is printed. Then, by discharging the paper S on which only the predetermined form TF is printed to a predetermined cassette (the first cassette 21 in the present embodiment) , such a paper S can be distinguished from other category of papers S. Further, the papers S on each of which only the predetermined form TF is printed can be collected in the predetermined cassette, and those papers S collected in the predetermined cassette can be used as papers S that can be reused.

Second Embodiment

In the first embodiment, one predetermined image TG is stored in the memory 15. In the present embodiment, a plurality of categories of predetermined images TG is stored in the memory 15. As long as the processing shown in FIG.

2 is respectively carried out on a plurality of papers S on which different predetermined forms TF are printed, a plurality of predetermined images TG containing different predetermined forms TF can be stored in the memory 15 respectively.

Figure 6:
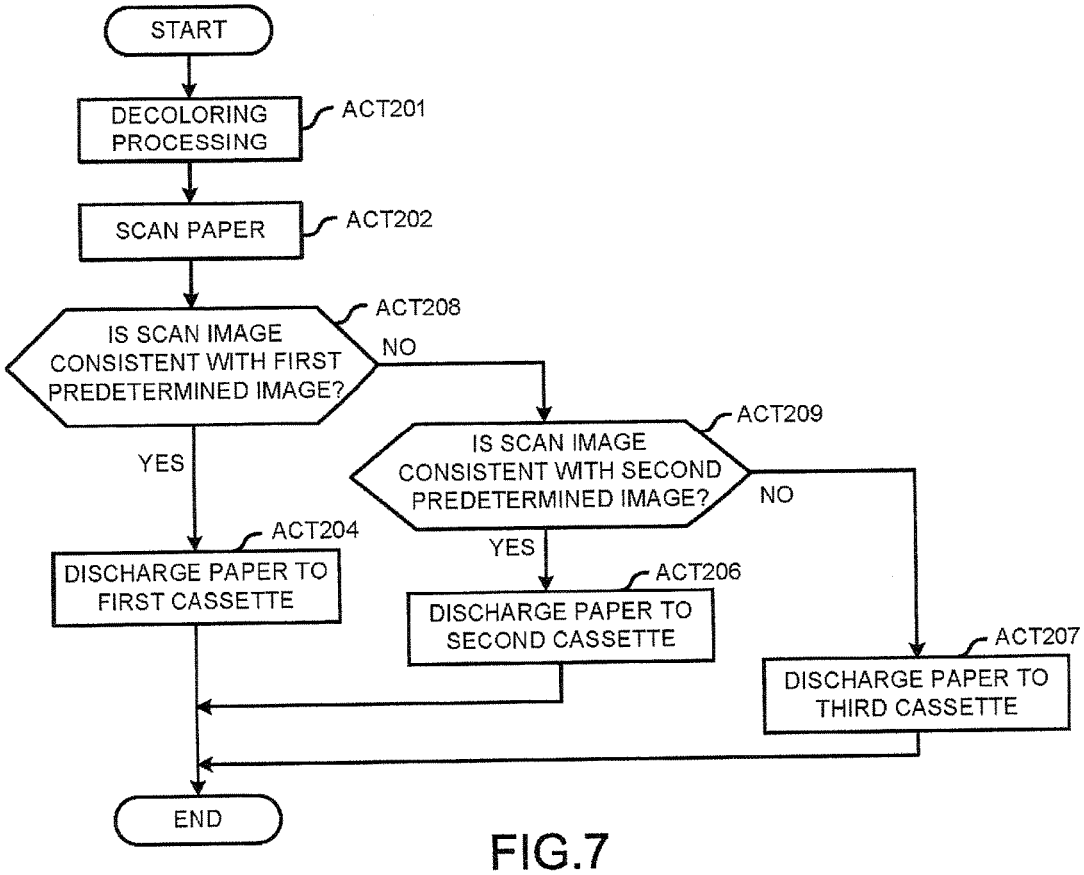
FIG. 6 is a flowchart illustrating a decoloring processing and a processing for distributing papers to which the decoloring processing is carried out in a second embodiment.

For example, the operations of the decoloring apparatus 1 when two predetermined images (a first predetermined image and a second predetermined image) TG are stored in the memory 15 are described with reference to FIG. 6. In FIG. 6, the same processing as those described in FIG. 4 is applied with same reference numerals.

In the processing in ACT 202, after the scanner 13 scans the paper S, the CPU 14 determines whether or not the scan image SG is consistent with the first predetermined image TG (ACT 208). When the scan image SG is consistent with the first predetermined image TG, the CPU 14 drives the conveyance rollers 33 and 35 and the flappers 41 and 42 to enable the scanned paper S to move along the conveyance path P4 and to be discharged to the first cassette 21 (ACT 204).

When the scan image SG is not consistent with the first predetermined image TG, the CPU 14 determines whether or not the scan image SG is consistent with the second predetermined image TG (ACT 209). When the scan image SG is consistent with the second predetermined image TG, the CPU 14 drives the conveyance rollers 33, 35 and 36 and the flappers 41~43 to enable the scanned paper S to move along the conveyance path P5 and to be discharged to the second cassette 22 (ACT 206). When the scan image SG is not consistent with the second predetermined image TG, the CPU 14 drives the conveyance rollers 33, 35~37 and the flappers 41~43 to enable the scanned paper S to move along the conveyance path P6 and to be discharged to the third cassette 23 (ACT 207).

According to the present embodiment, the papers S are classified by each kind of the predetermined form TF, and the papers S on each of which same predetermined form TF is printed can be collected in the same cassette.

Third Embodiment

In the first embodiment and the second embodiment, it is determined that whether or not the scan image SG is consistent with the predetermined image TG. In the present embodiment, regardless of the position of the predetermined form TF in the scan image SG, it is determined that whether or not the scan image SG includes the predetermined form TF.

Figure 7:
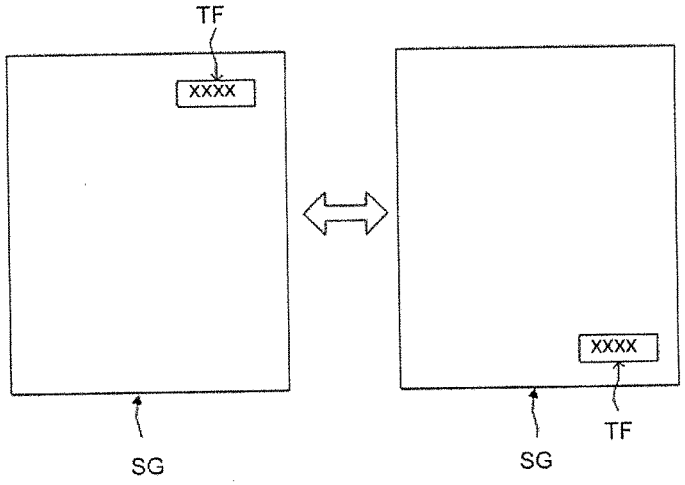
FIG. 7 is diagrams illustrating scan images on which predetermined forms are respectively formed at different positions.

As shown in FIG. 7, the predetermined form TF may exist in only part of area in the scan image SG according to the categories of the predetermined form TF. In addition, only the positions of the predetermined forms TF are different from each other. In this case, it can be determined that whether or not the scan image SG includes the predetermined form TF. In order to carry out this determination, only the image data of the predetermined form TF can be stored in the memory 15 in advance.

Figure 8:
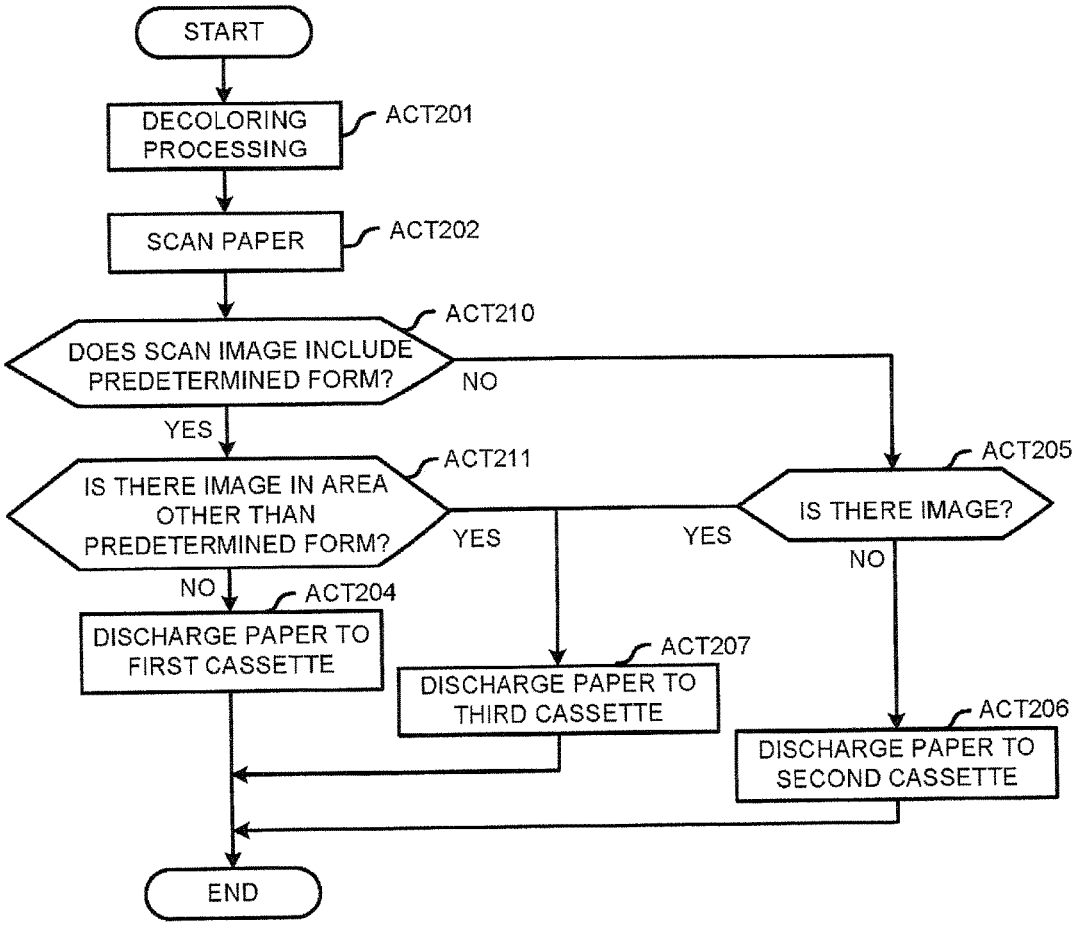
FIG. 8 is a flowchart illustrating a decoloring processing and a processing for distributing papers to which the decoloring processing is carried out in a third embodiment.

The determination processing is described with reference to FIG. 8. Further, in FIG. 8, the same processing as those described in FIG. 4 is applied with same reference numerals.

In the processing in ACT 202, after the scanner 13 scans the paper S, the CPU 14 determines whether or not the scan image SG includes the predetermined form TF (ACT 210). Specifically, the CPU 14 uses the image of the predetermined form TF stored in the memory 15 as a template to carry out template matching. In this way, it is possible to determine whether or not the scan image SG includes the predetermined form TF.

When the scan image SG includes the predetermined form TF, the CPU 14 determines whether or not there is an image in an area of the scan image SG other than the predetermined form TF (ACT 211). Such an image may be an image indicating a stain or a rip, or an image formed with a color material that cannot be decolored. When the CPU 14 extracts no image from the area of the scan image SG other than the predetermined form TF, the CPU 14 discharges the scanned paper S to the first cassette 21 (ACT 204).

In the processing in ACT 210, when the scan image SG does not include the predetermined form TF, the CPU 14 determines whether or not there is an image in the entire area of the scan image SG (ACT 205). Such an image may be an image indicating a stain or a rip, or an image formed with a color material that cannot be decolored. When there is no any image, stain or rip on the paper S, there is no image in the entire area of the scan image SG. In this case, the scanned image S is discharged to the second cassette 22 (ACT 206). When there is an image in the entire area of the scan image SG, or in an area of the scan image SG other than the predetermined form TF, the scanned paper S is discharged to the third cassette 23 (ACT 207).

According to the present embodiment, regardless of the position of the predetermined form TF on the paper S, the papers S on each of which only the predetermined form TF is printed can be collected in one cassette. Further, it is just required to store only the images of the predetermined forms TF in the memory 15 in advance, and thus there is no need to store the plurality of categories of predetermined images of which the positions of the predetermined forms are different from each other in the memory 15 in advance. Consequently, it is easy to guarantee the free space of the memory 15.

Fourth Embodiment

In the first-third embodiments, different categories of papers S are assigned and distributed to the cassettes 21-23. In the present embodiment, the plurality of categories of papers S is discharged to a same paper discharge tray and the paper discharging positions of the papers S are deviated from each other in the paper discharge tray according to the categories of the papers S.

Figure 9:
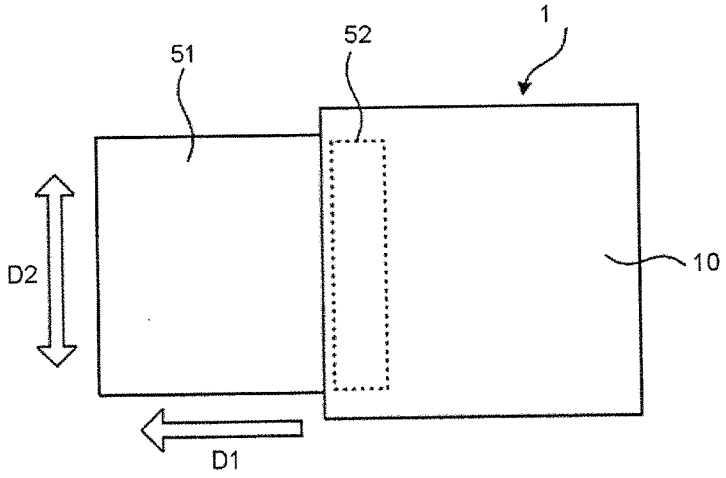
FIG. 9 is a top view illustrating a decoloring apparatus according to a fourth embodiment.

The constitution of a decoloring apparatus of the present embodiment is described with reference to FIG. 9. FIG. 9 is a top view of the decoloring apparatus 1.

The decoloring apparatus 1 shown in FIG. 9 includes a paper discharge tray 51 and a sort unit 52. The sort unit 52 can discharge the scanned papers S to a plurality of paper discharging positions on the paper discharge tray 51. Specifically, the sort unit 52 can differentiate the paper discharging positions of the papers S in the discharge direction D1 of the paper S, and can differentiate the paper discharging positions of the papers S in a direction D2 orthogonal to the discharge direction D1. Herein, the sort unit 52 can differentiate the paper discharging positions of the papers S at least in one of the direction D1 and the direction D2.

When differentiating the paper discharging positions of the papers S in the discharge direction D1, the sort unit 52 changes the discharge speed of the paper S. The higher the discharge speed of the paper S is, the farther the paper discharging position of the paper S is away from the sort unit 52. In other words, the lower the discharge speed of the paper S is, the closer the paper discharging position of the paper S is to the sort unit 52.

When differentiating the paper discharging positions of the papers S in the direction D2, the sort unit 52 deviates a conveyance roller pair in a state of holding the paper S in the direction D2 before the paper S is discharged to the paper discharge tray 51. The deviation amount of the conveyance roller pair in a state of holding the paper S in the direction D2 can be varied, and thus a plurality of paper discharging positions can be set.

According to the present embodiment, by differentiating the paper discharging positions on the paper discharge tray 51 according to the categories of the papers S, a plurality of categories of papers S can be sorted. Herein, the category of the paper S can be distinguished through the surface state of the paper S, and for example, it means that there is only image of predetermined form described later on the paper S, there is no any image, stain or rip on the paper S, and there is an image, stain or rip other than the predetermined form on the paper S.

Though it is described in the first-fourth embodiments that the "decoloring processing" is a processing of erasing the color of the image (toner), it also means to eliminate the image. That is, the decoloring apparatus of the present embodiment is not limited to an apparatus which erases the color of image by heating. For example, the decoloring apparatus may be an apparatus which erases the color of image by irradiating the paper with light, or an apparatus erasing the image formed on a special sheet. In order to reuse the paper, it is only required that the decoloring apparatus can make the image on the paper invisible.

Though it is described in the first-fourth embodiments that the image of predetermined form is read by the scanner and the image data is stored in the memory, the present invention is not limited to this case. That is, the image data of predetermined form may be received from an external device such as a personal computer, and then is stored in the memory.

According to the decoloring apparatus with the constitution above, it is possible to distribute the papers (the papers on which only the predetermined forms remain) on each of which the scan image is consistent with the predetermined image and the papers (other papers) on each of which the scan image is not consistent with the predetermined image.

While certain embodiments have been described, these embodiments have been presented by way of example only, and are not intended to limit the scope of the invention. Indeed, the novel embodiments described herein may be embodied in a variety of other forms; furthermore, various omissions, substitutions and changes in the form of the embodiments described herein may be made without departing from the spirit of the invention. The accompanying claims and their equivalents are intended to cover such forms or modifications as would fall within the scope and spirit of the invention.

What is claimed is:

1. A decoloring apparatus, comprising:

a decoloring unit configured to carry out a decoloring processing which decolors the color of an image formed on a paper with a decolorable color material;

a scanner configured to scan a predetermined paper and the paper to which the decoloring processing is carried out;

a memory configured to store data of a image generated by scanning the predetermined paper with the scanner;

a conveyance section configured to convey the papers scanned by the scanner to a plurality of paper discharging positions; and a control section configured to determine whether or not a scan image generated by the scanner is consistent with the image stored in the memory and to drive the conveyance section to convey the papers which represents the scan image being consistent with the image stored in the memory to same one of the plurality of paper discharging positions.

2. The decoloring apparatus according to claim 1, wherein the memory stores data of a predetermined image indicating a predetermined form formed on the paper with a non-decolorable color material.

3. The decoloring apparatus according to claim 1, wherein the plurality of paper discharging positions is a plurality of cassettes located at mutually different positions.

4. The decoloring apparatus according to claim 1, wherein the plurality of paper discharging positions are mutually different positions on a paper discharge tray.

5. A paper conveyance method, including:

carrying out, by a decoloring unit, a decoloring processing which decolors the color of an image formed with a decolorable color material on a paper;

scanning, by a scanner, a predetermined paper and the paper to which the decoloring processing is carried out;

storing data of a image generated by scanning the predetermined paper with the scanner in a memory;

determining whether or not a scan image generated by the scanner is consistent with the image that is stored in the memory; and driving a conveyance section to convey the papers which represents the scan image being consistent with the image stored in the memory to same one of a plurality of paper discharging positions.

6. The paper conveyance method according to claim 5, wherein the predetermined paper is a paper on which image indicating a predetermined form is formed with a non-decolorable color material.

* * * * *